US007785445B2

(12) United States Patent
Lundberg et al.

(10) Patent No.: US 7,785,445 B2
(45) Date of Patent: Aug. 31, 2010

(54) ARRANGEMENT FOR THE TREATMENT OF CELLULOSE PULP

(75) Inventors: Jörgen T. Lundberg, Sundsvall (SE); Rickard Andersson, Matfors (SE); Johan Bylander, Sundsvall (SE); Magnus Henriksson, Sundsvall (SE)

(73) Assignee: Metso Paper, Inc. (FI)

( * ) Notice: Subject to any disclaimer, the term of this patent is extended or adjusted under 35 U.S.C. 154(b) by 461 days.

(21) Appl. No.: 11/921,202

(22) PCT Filed: May 30, 2006

(86) PCT No.: PCT/SE2006/050174

§ 371 (c)(1),
(2), (4) Date: Nov. 28, 2007

(87) PCT Pub. No.: WO2006/130108

PCT Pub. Date: Dec. 7, 2006

(65) Prior Publication Data

US 2009/0101298 A1 Apr. 23, 2009

(30) Foreign Application Priority Data

Jun. 3, 2005 (SE) ..... 0501290

(51) Int. Cl.
*D21F 1/00* (2006.01)

(52) U.S. Cl. ..... 162/232; 134/115 R

(58) Field of Classification Search ..... 162/232, 162/380, 254; 134/115 R
See application file for complete search history.

(56) References Cited

U.S. PATENT DOCUMENTS 4,579,352 A 4/1986 Adang

FOREIGN PATENT DOCUMENTS

| | | | |
|---|---|---|---|
| DE | 41 31 472 | A1 | 3/1993 |
| DE | 198 22 521 | A1 | 11/1998 |
| GB | 2 180 893 | A | 4/1987 |
| SU | 781466 | A1 | 11/1980 |
| SU | 1622684 | A1 | 1/1991 |
| WO | WO-02/02204 | A1 | 1/2002 |

*Primary Examiner*—Mark Halpern
(74) *Attorney, Agent, or Firm*—Lerner, David, Littenberg, Krumholz & Mentlik, LLP

(57) ABSTRACT

A washing arrangement for washing and dewatering cellulose pulp is disclosed, comprising at least one rotary cylindrical element, against which the pulp is dewatered, and where a seal is located in an end seal holder, so that the seal has a contact surface against the rotary cylindrical element and an application surface placed against an applicator located in a groove in the end seal holder, where the seal has a longitudinal extension, which corresponds to either the entire or at least a greater part of the circumference of the cylindrical element, and is intended to seal against the end of the cylindrical element, and where the seal is a polymer ledge provided with an arming element.

9 Claims, 2 Drawing Sheets

A-A

ARRANGEMENT FOR THE TREATMENT OF CELLULOSE PULP

This application is a PCT/SE2006/050174 filed on 30 May 2006

FIELD OF THE INVENTION

The present invention relates to a washer intended for washing and dewatering cellulose pulp, comprising a seal to seal a rotary cylindrical element in the washer.

BACKGROUND OF THE INVENTION

All fiber lines include some type of washing arrangement in order to separate the digestion liquor from the pulp. Later on in the process washing equipment is provided to separate bleaching liquors after bleaching stages. There exist a plurality of different types of washing equipment operating according to different principles.

One type of washing arrangement is the drum washer where the pulp is dewatered on a rotary drum after the addition of washing liquid, which displaces the liquor remaining in the pulp web after preceding process stages, for example a digestion stage or a bleaching stage. Another known washing arrangement is a washing press consisting of two counter-rotating perforated rolls. These types of washing arrangements have in common that the rotary drum or roll is often sealed at the ends from the pressure in a forming or washing zone against the surrounding atmospheric pressure. The sealing is often created by an overall end seal, which extends about either the entire or greater parts of the circumference of the rotary cylindrical element, i.e. the circumference of the drum or roll. The seal is often made of a polymer material. The seal is applied to the rotary roll or drum, for example, by water pressure, air pressure or spring force and acts as a mechanical seal. The maximum overpressure in the forming or washing zone is about 1 bar, which implies that the applied contact pressure usually is about 1.5 to 2 bar.

In washing arrangements of the aforesaid type the diameter of the drums or rolls is often relatively great, which means that a peripheral end seal, which extends about the entire circumference of the drum or roll or at least about the greater part thereof, can be up to 10 to 15 m long. In relation to the thickness and width of the seal the length is great, because the magnitude of thickness and width is about some tens of mms. The force required to hold the seal in place and to prevent co-rotation is significant. If the friction coefficient against the roll or drum is also high, the force required to hold the seal in a desired position is still greater. As a consequence of the significant force strain, the seal gradually elongates by creep to eventually fracture. The progress is often accelerated, in that the polymer material in the seal softens by the heat and ages by chemicals present in the liquors within the washing arrangement.

Owing to the elongation of the polymer seal, problems can arise with the means which apply the seal against the roll/drum, because its position can be disturbed. The application means can be, for example, a pressurized rubber hose, or spring element or a combination thereof. When, for example, the application means is an overall rubber hose, it can be subjected to shearing and is elongated, which can imply that fracture can occur if it lands outside its groove. When the seal is not enclosed at its ends, it can at its elongation land outside its groove and get into contact with rotating machine parts or be damaged in another way. The application means can also be spring elements, which during elongation of the seal can be displaced.

One of the objects of the present invention is to solve the aforesaid problems.

SUMMARY OF THE INVENTION

In accordance with the present invention, these and other objects have now been realized by the invention of a washer for washing and dewatering cellulosic pulp material comprising a rotary cylinder against which the cellulosic pulp material is dewatered, a seal having a width defining a first surface and a second surface, and a length corresponding to a substantial portion of the circumference of the rotary cylinder, the seal mounted with respect to the rotary cylinder whereby the first surface contacts the rotary cylinder, an end seal holder for holding the second surface of the seal, the end seal holder including a groove for the seal, an applicator disposed within the groove in contact with the second surface of the seal, the seal comprising a polymer ledge, an arming element comprising a steel band disposed within the polymer ledge, and a plurality of joints disposed along the length of the seal for attaching the arming element to the polymer ledge. Preferably, the seal includes a first end and a second end defining the length of the seal, the first end being fixed in the circumferential direction and the second end being movable in the circumferential direction. Most preferably, the length of the seal is less than the circumference of the rotary cylinder.

In accordance with one embodiment of the washer of the present invention, the plurality of joints are pins or screws.

In accordance with another embodiment of the washer of the present invention, the arming element has a first width and the seal has a second width, the first width comprising only a portion of the second width.

In accordance with another embodiment of the washer of the present invention, the arming element has a first end and a second end defining a first width, the first end corresponding to the second surface of the seal. In another embodiment, however, the arming element has a first end and a second end defining a first width, the first end being displaced from the second surface of the seal.

In accordance with another embodiment of the washer of the present invention, the first width comprises about one-half of the second width.

In accordance with another embodiment of the washer of the present invention, the polymer ledge has a predetermined thickness, and the arming element is disposed within the polymer ledge at a location corresponding to about one-half of the predetermined thickness.

By arming the polymer seal with a material, which has other properties than the polymer material of the seal, the tensile stresses arising in the seal during its operation can be counteracted. The armed material can preferably be placed as a thin reinforcing element at the center of the polymer seal, as seen in the thickness direction. The reinforcing element is preferably placed a bit in the seal, seen from the long sides. When the reinforcing element is placed all the way out to the side, which is intended to abut to the application means, the application means will have an inferior support surface to rest on, which can result in inferior sealing, because the reinforcing element can damage the application means and thereby cause worse contact of the seal against the rotary element. The arming element preferably extends only partially through the width of the seal. According to one embodiment of the present invention, the arming element extends through half the width of the seal. The extension is to be selected so that the risk that the arming element during the wear of the contact surface of the seal will land against the rotating element is minimized. The arming element could then damage the rotating element.

The polymer material in the seal should have a low friction coefficient and good chemical resistance. The arming element consists of an easily flexible material with a higher yield point than the polymer material in the seal. The arming material also should have properties such as low heat expansion coefficient, low tendency to creep, high chemical and heat resistance, low water absorption and high flexibility. Examples of such material can be thin steel band, steel wire, glass fiber or carbon fiber. The arming element can preferably consist of a thin steel band of the magnitude of some mm. The steel band should not be so thick that it impedes the flexibility of the seal.

The arming element can be attached to the polymer ledge by means of a number of joints placed along the longitudinal extension of the sealing. These joints may consist, for example, of pins or screw joints.

BRIEF DESCRIPTION OF THE DRAWINGS

The invention is further described in the following detailed description, with reference to the Figures, in which.

DETAILED DESCRIPTION

Figure 1:
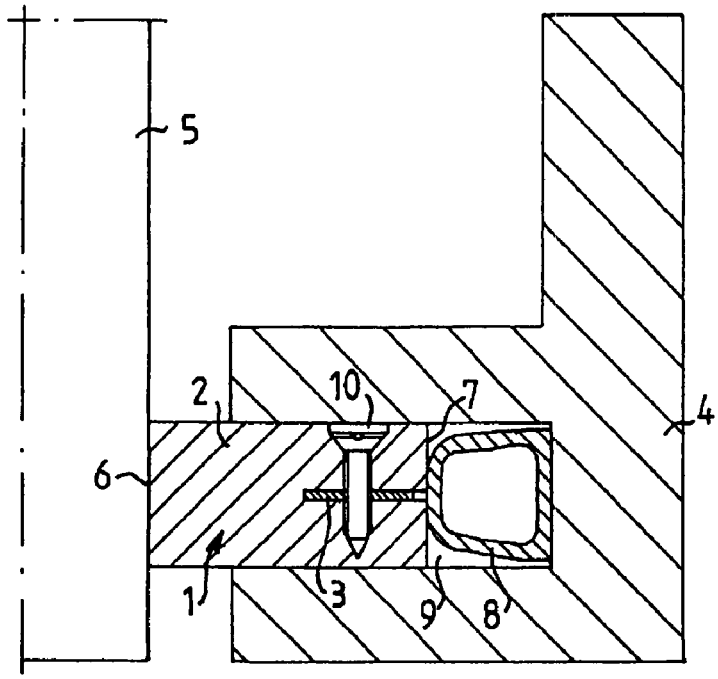
FIG. 1 is a side, elevational, sectional, partial view of a portion of the washing arrangement according to the present invention.

Referring to the Figures, in which like reference numerals refer to like elements thereof, FIG. 1 shows a sealing means in a washer according to the present invention. A seal 1 consisting of a ledge 2 of a polymer material, and provided with an armed element 3 is located in an end seal holder 4. The seal is located so as to abut against a drum/roll 5 in the washing arrangement, so that a first side of the seal constitutes a contact surface 6 to the drum/roll and a second side an application surface 7 located against the application means 8. The application to the drum/roll 5 is controlled by means of the application means 8 which, for example, can consist of a pressurized rubber hose or a spring element, or a combination thereof. The end seal holder is constructed with a groove 9, in which the seal 1 and the application means 8 are located. The application means is preferably not attached to the seal, but is located so as to abut tightly to the same. The arming element in the form of a thin steel band is attached to the polymer ledge by a plurality of joints 10 located along the longitudinal extension of the seal. The joints can suitably consist of pins or screw joints.

A major advantage of the proposed seal is that it may be manufactured using standard components in a simple and less expensive manner than, for example, seals the manufacture of which involve casting processes.

Figure 2:
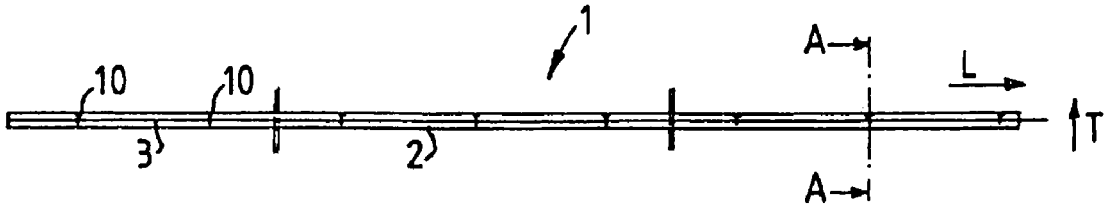
FIG. 2 is a partial, top, elevational view of a seal used in the washing arrangement of the present invention.

FIG. 2 shows a seal 1 intended to be used in the washing arrangement, extended in a longitudinal direction L, where the length of the seal corresponds to the entire or at least the greater part of the circumference of the drum or roll of the washing arrangement. In roll presses the length of the seal corresponds to less than the entire circumference of the roll. At the center of the seal, as seen in a thickness direction T, an arming element 3 is provided. The arming element 3 is attached to the polymer ledge 2 of the seal by means of joints 10 placed equally spaced in the polymer ledge 2.

Figure 3:
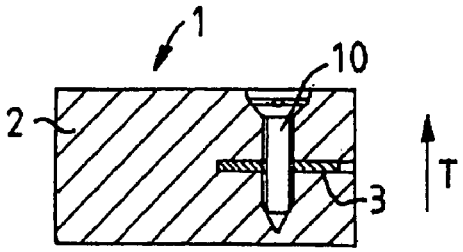
FIG. 3 is a side elevational, cross-sectional view taken along line A-A of the seal shown in FIG. 2.

FIG. 3 shows a seal 1 according to the present invention by view of a cross-section A-A in FIG. 2. The seal is formed of a polymer ledge 2, in which an arming element 3 is located approximately at the center of the seal in the thickness direction T. The arming element is attached to the polymer ledge by means of a number of pins 10.

Figure 4:
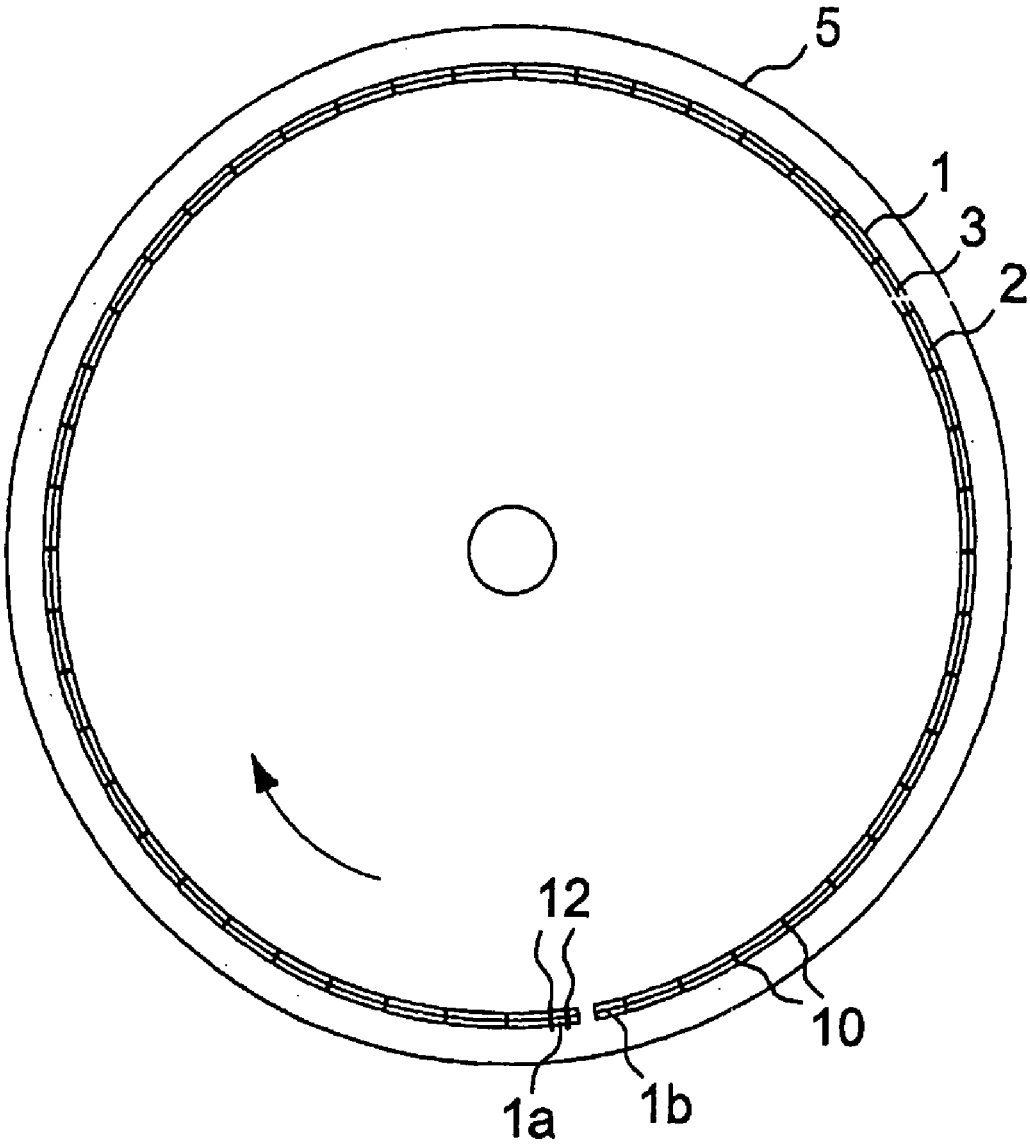
FIG. 4 is side, elevational a schematic view of a washing arrangement according to an embodiment of the present invention with a seal arranged at the end of a rotary cylindrical element.

FIG. 4 is a schematic illustration of a washing arrangement according an embodiment of the present invention with a seal 1 arranged to seal against the end of a rotary cylindrical element 5. The length of the seal 1 corresponds to less than the entire circumference of the roll/drum 5. In other words, the seal 1 substantially forms an "interrupted circle", enclosing less than 360°. The seal 1 can, for example, form a circle with a gap of in the order of 2° to 6°. The seal of FIG. 4 is a polymer ledge 2 provided with a steel band forming an arming element 3 by means of which the tensile stresses arising in the seal during operation can be counteracted. The steel band is attached to the polymer ledge 2 by means of a number of joints 10 placed along the longitudinal extension of the seal 1. The seal has two ends, 1*a* and 1*b*, and is preferably fixed at one end portion 1*a*, while the other end 1*b* is arranged to be movable in the circumferential direction (lengthwise). As seen in the direction of rotation, the fixed end 1*a* is the first end. The fixed seal end can be achieved by fixing the steel band (and generally also the polymer ledge since the polymer ledge normally would be about the same length as the steel band) to a member of the washing arrangement which is prevented from moving freely in the circumferential direction (i.e. prevented from giving way to the rotational force). The fixed seal end should thus be fixed in the vicinity of one of the ends of the steel band. The fixing mechanism is represented in FIG. 4 by two joints 12 protruding outside the polymer ledge, and the skilled person will recognize that various fixing solutions are possible, e.g. including one or more intermediate members.

By means of the seal arrangement of FIG. 4, tensile stresses of the seal can be counteracted in an efficient manner. The seal is held in the fixed steel band end portion and tensile stresses are transferred through the steel band with its joints instead of affecting the polymer ledge. The resulting seal is flexible and resistant to tensile stresses and will thus be associated with a comparatively long life.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A washer for washing and dewatering cellulosic pulp material comprising a rotary cylinder against which said cellulosic pulp material is dewatered, a seal having a width defining a first surface and a second surface, and a length corresponding to a substantial portion of the circumference of said rotary cylinder, said seal mounted with respect to said rotary cylinder whereby said first surface contacts said rotary cylinder, an end seal holder for holding said second surface of said seal, said end seal holder including a groove for said seal, an applicator disposed within said groove in contact with said second surface of said seal, said seal comprising a polymer ledge, an arming element comprising a steel band disposed within said polymer ledge, and a plurality of joints disposed along said length of said seal for attaching said arming element to said polymer ledge.

2. The washer of claim 1 wherein said seal includes a first end and a second end defining said length of said seal, said first end being fixed in said circumferential direction and said second end being movable in said circumferential direction.

3. The washer of claim 2 wherein said length of said seal is less than said circumference of said rotary cylinder.

4. The washer of claim 1 wherein said plurality of joints are selected from the group consisting of pins and screws.

5. The washer of claim 1 wherein said arming element has a first width and said seal has a second width, said first width comprising only a portion of said second width.

6. The washer of claim 5 wherein said first width comprises about one-half of said second width.

7. The washer of claim 1 wherein said arming element has a first end and a second end defining a first width, said first end corresponding to said second surface of said seal.

8. The washer of claim 1 wherein said arming element has a first end and a second end defining a first width, said first end being displaced from said second surface of said seal.

9. The washer of claim 1 wherein said polymer ledge has a predetermined thickness, and said arming element is disposed within said polymer ledge at a location corresponding to about one-half of said predetermined thickness.

* * * * *